US005592835A

United States Patent [19]

Herr

[11] Patent Number: 5,592,835

[45] Date of Patent: Jan. 14, 1997

[54] NECKLACE WITH MEANS FOR ADDING GEM STONES THERETO

[76] Inventor: Andria R. Herr, 310 S. Pressview Ave., Longwood, Fla. 32750

[21] Appl. No.: 533,117

[22] Filed: Sep. 25, 1995

[51] Int. Cl.[6] ..... A44C 5/02

[52] U.S. Cl. ..... 63/4; 63/21

[58] Field of Search ..... 63/4, 21, 23, 9, 63/26; 59/80, 82

[56] References Cited

U.S. PATENT DOCUMENTS

| | | | |
|---|---|---|---|
| 1,344,365 | 6/1920 | Wachenheimer | 59/82 X |
| 1,467,468 | 9/1923 | Blanchard | 63/4 |
| 2,634,593 | 4/1953 | Moretti | 63/4 |
| 2,714,269 | 8/1955 | Charles | 63/4 |
| 4,400,932 | 8/1983 | Epstein | 59/82 |

*Primary Examiner*—Kien T. Nguyen
*Attorney, Agent, or Firm*—Macdonald J. Wiggins

[57] ABSTRACT

A necklace formed of a plurality of interconnected globular like beads wherein the beads are adapted to permit installation of gemstones in selected beads, and for adding gemstones at later times. A central pendant includes a central bead having a pair of beads, each of which are permanently attached thereto at about a 45 degree angle with respect to a vertical center line of the central bead. A pair of strings of single beads is formed with one of each attached to the pendant. The single beads are movably linked to form two strings thereof having clasp for forming a necklace. Each of the pendant beads and the string beads are globular in shape, and include a partial rear central bore therein. At any time, a bead can easily be modified to form a gemstone setting in the front face thereof, and a stone installed therein. Thus, the necklace of the invention can provide a means for celebrating anniversaries and other special occasions.

3 Claims, 2 Drawing Sheets

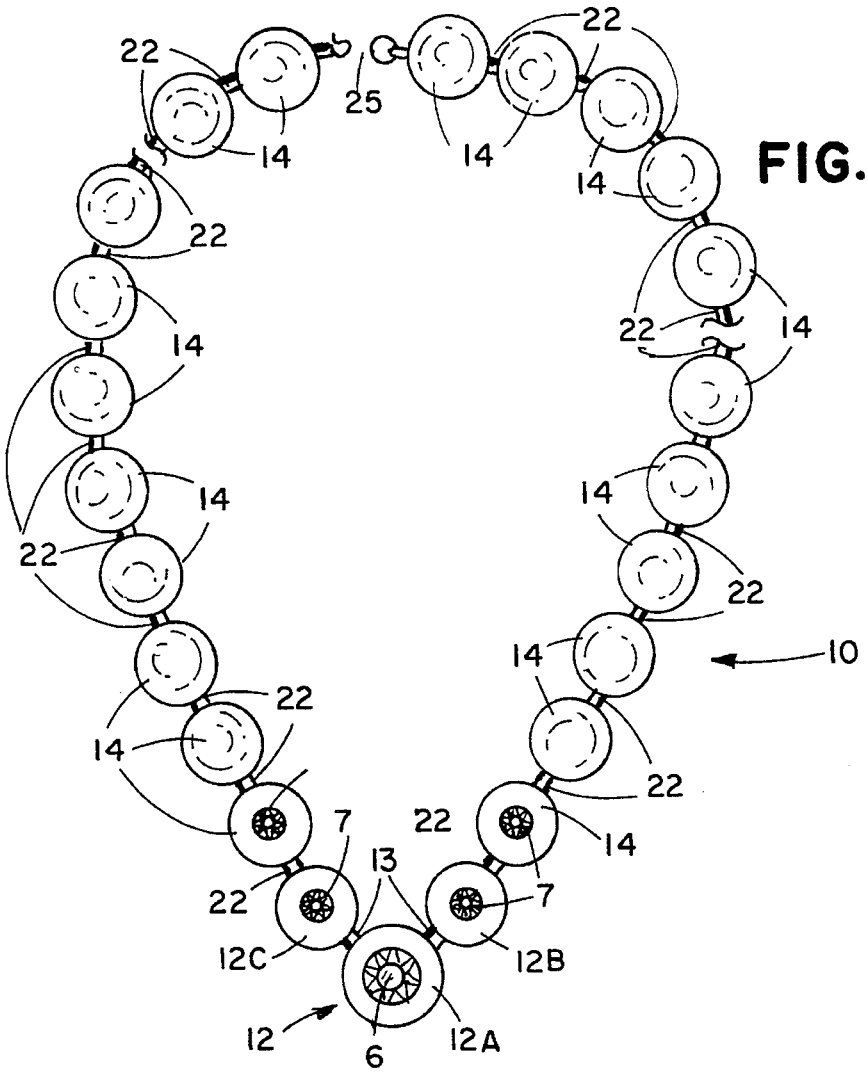
FIG. 1
FIG. 2
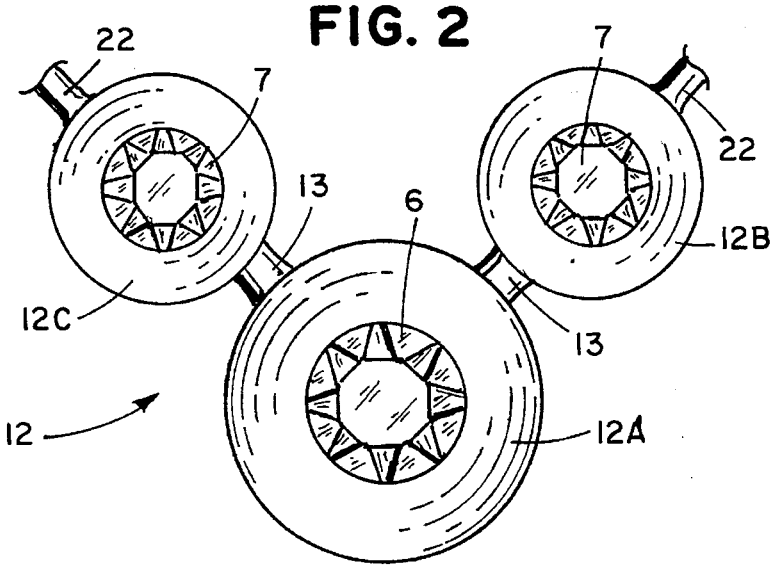

NECKLACE WITH MEANS FOR ADDING GEM STONES THERETO

BACKGROUND OF THE INVENTION

1. Field of the Invention

The present invention relates to a necklace formed of a plurality of interconnected globular-like beads and adapted to have gemstones mounted in selected ones of the beads if desired, and for adding gemstones thereto at later times.

2. Description of the Prior Art

The use of beads and the like linked together to form a necklace is well known. For example, please note the following U.S. patents:

U.S. Pat. No. 2,942,318 to Charles:

This patent discloses several types of ornamental beads having means for snapping the beads together to form a chain or the like. The disclosure shows a bead on one link that snaps into a partially spherical socket in an adjacent bead. No mention of utilizing gem stones in the beads is noted.

U.S. Pat. No. 5,339,655 to Grando:

A plurality of links is shown in which an individual link (FIG. 6) is opened and bent to link with an adjacent link. Each link includes an opening for receiving a gem stone. A crown contacts a bottom of the gem stone to hold it in place.

U.S. Pat. No. 5,339,655 to Poel:

A metal platelet has four bars in the form of a cross with a cone for accepting a gem. A plurality of individual rings link platelets together to form a chain, or a compound of platelets as in FIGS. 1 and 2.

U.S. Pat. No. 4,781,038 to Branca et al.:

A linkable gem setting is shown having fingers formed to receive a gemstone. A small apertured pad links with a finger as seen in FIG. 2. Thus various forms of chains of settings can be formed. Each link requires a gem stone.

SUMMARY OF THE INVENTION

The necklace of the present invention comprises a central pendant element having a first semi-globular bead, and a first pair of slightly smaller semi-globular beads rigidly attached to the first semi-globular bead, each smaller bead extending upward at an angle thereto. If desired, each bead may include a gemstone in its center, or gemstones may be added at a later time. A plurality of the smaller semi-globular beads are movably coupled to each other and to the first pair of smaller beads to form two trains of such elements. The couplings permits the elements to move laterally with respect to each other. Thus, a pair of chains is formed, each chain attached to a respective one of the first pair of pendant smaller semi-globular beads. The semi-globular beads at each outer end of each chain has a clasp, permitting coupling of the clasps to thereby form a necklace.

The central pendant element is thus spaced opposite the clasps and serves as a weight to maintain the necklace centered while being worn.

These and other objects and advantages of the invention will become apparent from the following detailed description when read in conjunction with the drawings.

BRIEF DESCRIPTION OF THE DRAWINGS

FIG. 1 shows a front view of a necklace of the invention shown with the clasps open, and having, as an example, gemstones installed in the three central semi-globular beads, and in two of the linked smaller semi-globular beads, with the remainder of the semi-globular elements having no gemstones mounted therein;

FIG. 2 is a front view of the three rigidly coupled central semi-globular elements, each having a gemstone mounted therein;

DETAILED DESCRIPTION OF THE PREFERRED EMBODIMENT

Figure 3:
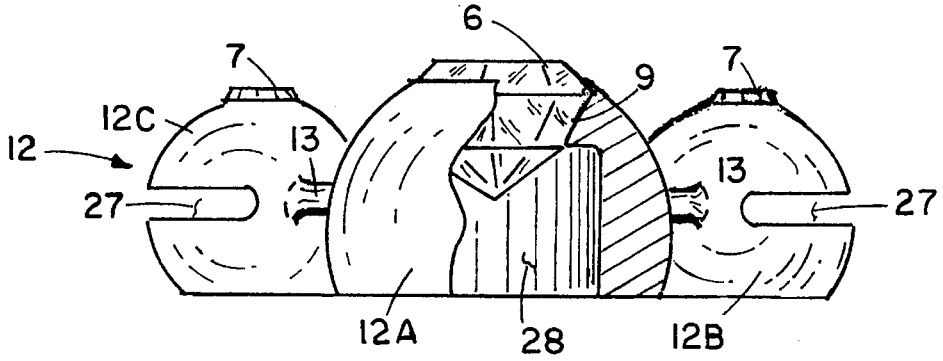
FIG. 3 is an elevation view of the pendant portion of the necklace, partially cut away to disclose a mounting of the gemstone, a cylindrical bore in a lower portion there, and the rigid couplings between the semi-globular beads.

With reference to FIG. 1 of the drawings, the invention provides a novel necklace 10 having a pendant element 12, and a plurality of semi-globular beads 14 attached thereto. Beads 14 are connected to each other by a coupling link that permits movement between adjacent beads. Beads 12 and 14 are formed of metal, preferably of one of the noble metals. Pendant element 12 includes a central semi-globular bead 12A having a pair of smaller semi-globular beads 12B and 12C rigidly attached thereto by connectors 13. Advantageously, beads 12B and 12C are each disposed at an angle of about 45 degree with respect to a vertical center line of bead 12A. This configuration adds weight to a the lower central portion of necklace 10 to thereby tend to maintain pendant element 12 centered with respect to necklace 10 when the necklace is worn.

Bead 12A is shown with a gemstone 6 mounted in the center thereof, in a manner discussed hereinafter. Also, each smaller bead, 12B and 12C, is shown with a smaller gemstone 7 mounted in the center thereof. Smaller beads 12B and 12C are rigidly attached to central bead 12A by connectors 13 therebetween. As an example, beads 14 linked to beads 12A and 12C are shown having gemstones 7 mounted therein. However, gemstones are not essential to the invention, but can be installed at any time after initial purchase of a necklace 10. Link rods 22 extending from beads 12B and 12C are utilized to link to individual beads 14 as described in detail hereinbelow. The lengths of link rods 22 are selected in accordance with the amount of flexibility desired for the necklace of FIG. 1.

FIG. 3 is an elevation view of pendant 12 from the lower end thereof. As shown in a cutaway portion of bead 12A, a cylindrical bore 28 is provided in a central portion thereof, with gemstone 6 in setting at the upper end thereof. This novel construction thus permits installation of additional gemstones to the beads of the invention at any time after initial purchase. Smaller beads 12B and 12C also are shown, each having a smaller gemstone 7 installed therein. Beads 12B and 12C have slots 27 in each side thereof as a design feature.

Figure 4:
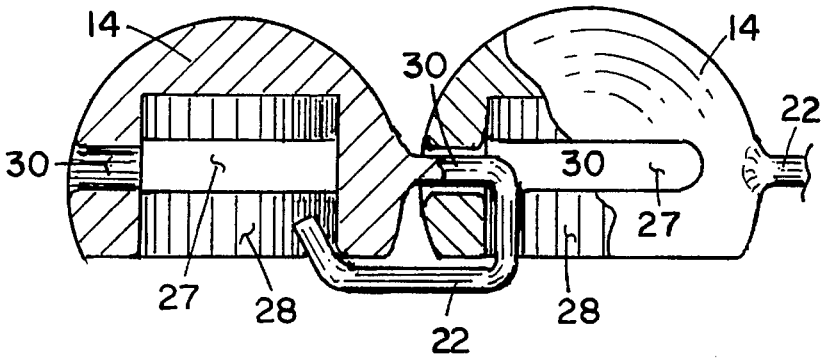
FIG. 4 is an elevation view of two of the smaller semi-globular beads that do not have gemstones mounted therein, and that are shown partially cut away to reveal the method of providing a movable link therebetween and the cylindrical bores therein.

FIG. 4 is an elevation side view of two of the small linked beads 14 having the left bead 14 cutaway through a centerline thereof showing bore 28, link opening 30, and link 22 linking with right bead 14, via its link opening 30, and partially cutaway to show the position of left bead link 22. The length of link rod 22 can be selected to control the amount of play and movement between beads 14 as mentioned above.

It is to be understood that the invention does not require a gemstone to be initially installed in any of the beads 12A, 12B, 12C, 14, or 16, thus, the necklace 10 can be sold with no gemstones, or with any desired number. One of the important features of the necklace is the design that permits a gemstone to be installed in any of the beads 12, 14 at any time desired after assembly of the beads to form the necklace 10. For example, one or more gemstones may be installed at an anniversary, a birthday, or at other important times. Thus, beads 12 and 14 each have a central bore 28 to permit a jeweler to easily install such gemstone with minimum waste of metal.

In accordance with the method of the invention, a jeweler can, at any time, punch or drill an opening through central bore 28 of a bead, form a setting in its outer surface, as shown at 9 in FIG. 3, and thereafter install the desired gemstone therein.

Figure 5:
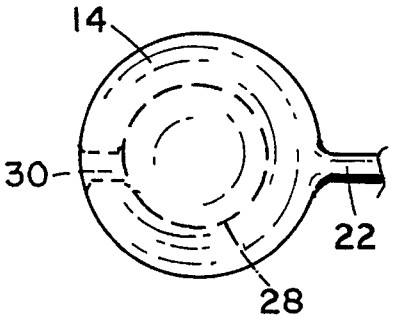
FIG. 5 is a top plan view of a semi-globular bead of the invention.
Figure 6:
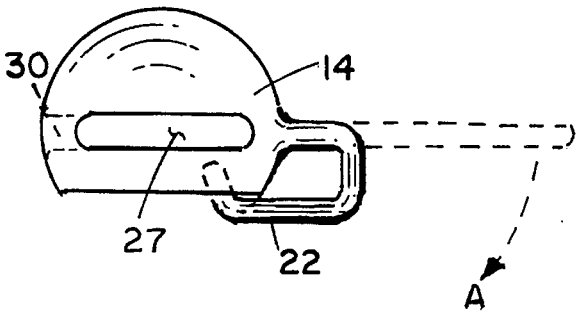
FIG. 6 is an elevation view of the semi-globular bead of the invention.

FIG. 5 is a top view of a bead 14 isolated from the necklace. Central bore 28 and link opening 30 are shown in phantom view. FIG. 6 is a side view of a bead 14 of FIG. 5 prior to coupling with an adjacent bead. Link element 22 is inserted through link opening 30 of an adjacent bead, bent downward as indicated by arrow A, and the distal end thereof bent back at a right angle, and thereafter bent upward into its bore 28. To facilitate the mounting process, a jeweler can easily remove a bead 14 when desired by temporarily bending the connecting links of such bead and then separating the links.

A new and novel necklace has been disclosed that permits gemstones to be easily added thereto. The description should be considered a illustrative of the invention, and not as limiting. For example, the invention is not limited to circular beads since the novel concept may be practiced with other bead configurations. Other changes and modifications will occur to those skilled in the art without departing from the spirit and scope of the invention. In addition, a method of adding gemstones to necklace 10 has been disclosed that permits a jeweler to access a bead 12, 16, or 14 through a central bore 28 and form a setting in an outer surface of such bead.

I claim:

1. A necklace having means for installing gemstones therein after purchase of the necklace by a consumer comprising:

a) a pendant element composed of a central semi-globular metallic bead and first and second semi-globular metallic beads rigidly attached to said central bead, such that imaginary lines through the centers of each of said first and second attached beads, and through a center of said central bead form essentially a right angle therebetween having said central bead at the apex thereof;

b) a plurality of said semi-globular beads having linking means for movably linking said beads together to form a pair of strings thereof, one of said strings attached to said first attached bead, and a second of said strings attached to said second attached bead, said strings including means for coupling said pair of strings to form said necklace;

c) whereby said pendant element serves as a weight to maintain said necklace centered when being worn; and d) each of said beads of said pendant and said beads of said strings includes a central partial cylindrical bore from a rear surface thereof formed therein, thereby providing a region thereabove each of said beads for subsequent forming of a gemstone setting in a front face thereof, said setting for mounting of a gemstone.

2. The necklace as defined in claim 1 in which said string coupling means is a clasp assembly.

3. The necklace as defined in claim 1 in which said link coupling means includes:

a) a link opening through one side of each bead of said strings into said central bore thereof;

b) a straight link element projecting from a side of each bead of said strings opposite said link opening; and c) wherein a first bead is coupled to a second bead by insertion of said straight link element into an adjacent link opening, and thereafter bending said link element to engage a lower portion of said central bore.

* * * * *